US005187407A

United States Patent [19]

Borgis et al.

[11] Patent Number: 5,187,407

[45] Date of Patent: Feb. 16, 1993

[54] ELECTRIC LAMP

[75] Inventors: Livio Borgis; Marco V. P. Piacibello, both of Turin, Italy; Peter C. Keim, Oostkapelle, Netherlands

[73] Assignee: U.S. Philips Corporation, New York, N.Y.

[21] Appl. No.: 795,421

[22] Filed: Nov. 20, 1991

[30] Foreign Application Priority Data

Nov. 30, 1990 [NL] Netherlands ..... 9002619

[51] Int. Cl.[5] ..... H01K 1/46

[52] U.S. Cl. ..... 313/318; 313/315; 439/615; 439/616

[58] Field of Search ..... 313/315, 318; 439/611, 439/612, 615, 616, 618

[56] References Cited

U.S. PATENT DOCUMENTS 2,188,298 1/1940 Hitchcock ..... 313/318 X 2,626,369 1/1953 Dailey ..... 439/613 X 5,039,905 8/1991 Essers et al. ..... 313/318

FOREIGN PATENT DOCUMENTS 1430972 4/1976 United Kingdom .

*Primary Examiner*—Donald J. Yusko

*Assistant Examiner*—Ashok Patel

*Attorney, Agent, or Firm*—Robert J. Kraus

[57] ABSTRACT

The electric lamp is provided with a cap (3) having a base (9) of insulating material bearing a metal disc (4) on an outer surface thereof. The disc (4) and the base (9) have an opening (10) through which a current supply conductor (6) extends, that is attached to the disc (4) by means of solder (11). A girdle of holes (12) in the disc (4) surrounds the opening (10) and the solder (11). The girdle of holes (12) prevents the soldering flux and the solder (11) from flowing over the whole surface of the disc, thereby limiting the amount of flux and solder used.

2 Claims, 1 Drawing Sheet

ELECTRIC LAMP

BACKGROUND OF THE INVENTION

The invention relates to an electric lamp comprising:

a lamp vessel in which a light source is arranged;

a lamp cap connected to the lamp vessel and provided with electric contacts;

current supply conductors connected to the light source and to respective contacts of the lamp cap;

the lamp cap having a metal shell and a base of insulating material which has an exterior surface which carries a metal disc as an electric contact; and a current supply conductor issuing through an opening in the base and in the metal disc to the exterior, where it is fixed to the disc with solder.

Such a lamp is generally known and is widely used.

The lamp cap of the lamp may be of the Edison type and may carry a metal disc centrally positioned at the base as an electric contact. Alternatively, the lamp cap may be of the bayonet type. It then has a centrally positioned metal disc or a first and second metal disc as contacts at the base.

A centrally positioned disc, for example in the case of Edison lamp caps, may be as large as 10 or 14 mm in diameter. That is much larger than is required for realising a soldered connection between the relevant current supply conductor and the disc. In the case of bayonet lamp caps having a first and a second disc at the base, the discs may be elliptical with dimensions of, for example, 5.5×11 mm. These dimensions are also much larger than is required for rendering a soldered connection possible, but necessary for keeping the contacts touching the contact members of the lampholder when the lamp is inserted in the lampholder, and during relative rotation in the lampholder.

If good soldered joints between a current supply conductor and the relevant metal disc are to be made, it is necessary for a soldering flux to be provided on the heated disc, which flux cleans the disc surface and renders flow and adhesion of the solder possible. The solder flux, for example a solution of $ZnCl_2$ and $NH_4Cl$ in glyercol/water, then runs boiling and in an uncontrolled fashion over the entire surface of the disc, and can then run off the disc over the base to the shell of the lamp cap. Soldering flux residues may remain at the base, for example, in hair cracks in the base. They can cause a conductive connection between the metal disc at the base and the shell of the lamp cap, so that the light source of the lamp is short-circuited.

The consumption of soldering flux is high owing to a relatively large surface of a metal disc. In addition, a large cleaned surface entails that the solder can flow over a large surface. This renders the solder consumption high. The random and uncontrolled fashion in which the soldering flux and the solder flow out over the surface of the metal disc, during which it is important whether the disc is flat and whether it is held horizontal, have the result that the shape and the location of the solidified solder can strongly vary in a finished lamp.

It should be noted that GB-1 430 972 discloses a bayonet lamp cap having contacts at its base which are different from conventional contacts as regards shape, dimensions, and position. The contacts each have a first region which is to make contact with contact elements of a lampholder and a second region on which the soldered connection with the relevant current supply conductor is made. These regions are entirely separated from one another by a groove which is to prevent solder flowing out from the second region over the first region.

SUMMARY OF THE INVENTION

It is an object of the invention to provide a lamp of the kind described in the opening paragraph which, among other characteristics, is of a simple construction and renders a low consumption of solder and soldering flux possible.

According to the invention, this object is achieved in that the opening in the metal disc and the solder together are surrounded by a girdle of holes in the disc.

The girdle of holes restricts the surface area of the disc around the opening in the disc, while on the other hand the surface area of the base covered by the disc and the contours of the disc need not be changed as regards size and shape. As a result, the lamp cap complies with requirements set for it in order to safeguard that electrical contact is made with contact members in a lampholder.

The girdle of holes prevents soldering flux from flowing away between the holes of the area of the disc outside the girdle. Considerably less soldering flux need be provided near the opening in the disc in order to clean the area around this opening inside this girdle. The flow of solder to the region outside the girdle is also limited. The result is that considerably less solder can be used, while nevertheless the realisation of a good soldered joint is safeguarded.

The restriction of the use of soldering flux and solder is not only important for economic reasons, but also because of less environmental pollution occurring owing to soldering during lamp manufacture and after the lamp has reached the end of its life. Furthermore, the material becoming available from the girdle of holes in the disc during lamp cap manufacture can be collected and reused.

It is obvious that it is immaterial for the essence of the invention of which type the light source of the lamp is: an incandescent body, whether or not in an inner envelope, a pair of electrodes, whether or not comprising means for shaping a beam or for influencing the spectrum of the emitted radiation or for igniting the lamp and controlling the current through the lamp.

BRIEF DESCRIPTION OF THE DRAWING

Embodiments of the lamp according to the invention are shown in the drawing, in which.

DESCRIPTION OF THE PREFERRED EMBODIMENTS

Figure 1:
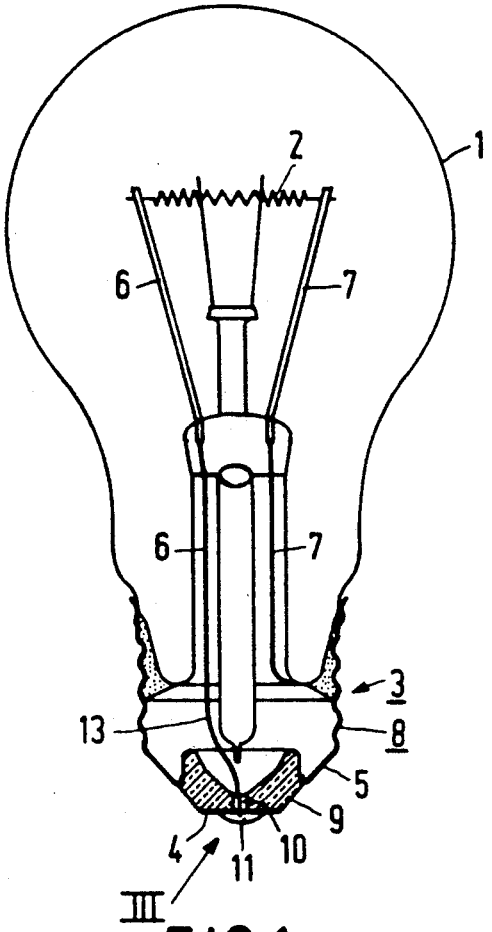
FIG. 1 shows a first embodiment in lateral elevation, with the lamp cap in longitudinal section.

In FIG. 1, the lamp has a lamp vessel 1 in which a light source 2 is positioned. In the lamp drawn the source 2 is an incandescent body. A lamp cap 3, an Edison lamp cap in the Figure, is connected to the lamp vessel 1 and provided with electric contacts 4, 5. Current supply conductors 6, 7 are connected to the light source 2 and to respective contacts 4, 5 of the lamp cap 3. The lamp cap has a metal shell 8, which in this embodiment also forms the contact 5, and a base 9 of insulating material, for example of glass, such as vitrite. The base 9 carries as its outer surface a metal disc 4 as an electric contact. A current supply conductor 6 issues through an opening 10 in the base 9 and in the disc 4 to the exterior, where it is fixed to the disc with solder 11, for example, with Pb/Sn in the ratio of 95/5 (by weight) or with Pb/Sb in the ratio of 99.5/0.5 (by weight).

The opening 10 and the solder 11 are together surrounded by a girdle 12 (FIG. 3) of holes in the disc 4.

In the lamp shown, the metal disc has a girdle of 8 holes of approximately 2 mm diameter and an interspacing of approximately 0.5 mm. This pattern can be easily realised in a disc of the size drawn (approximately 10 mm diameter). However, the pattern may be adapted for discs of different types or sizes. Thus the holes in larger discs may be oblong, for example oval, in, for example, radial direction.

A 40% reduction in the solder consumption and a 30% reduction in the soldering flux consumption were realised in the lamp shown. A high degree of reliability of the connection obtained was found. In addition, it was found that a serious defect in lamp manufacture is effectively counteracted in the lamp according to the invention. It can happen in lamps having conventional lamp caps that solder runs through the openings in the metal disc and in the base of the lamp cap and into the lamp cap, where it solidifies in the form of a wire, during making of the soldered connection. The wire may be in contact with the relevant current supply conductor as well as with the lamp cap shell, thus causing a short-circuit in the lamp cap. In bayonet lamp caps, a short-circuit can also occur through connection of two current supply conductors, but another risk is that the metal shell becomes live, which is not permitted in bayonet lamp caps having two contacts at the base.

The holes of the girdle 12 in the lamp shown are filled with the material of the base 9. The disc 4 thus has an additional coupling to the base 9, which absorbs shear stresses. The mould in which the base is formed, however, may alternatively be so shaped that the holes are empty. No influence of this on the reduction of the consumption of solder and soldering flux was observed.

In this lamp, the area of the soldered connection coincides with the area where a contact element of a lampholder will touch the contact. This is the result of the conventional shape, dimensions and location which the contact can have, apart from the holes, and of the fact that the solder is the farthest protruding portion at the base.

Figure 2:
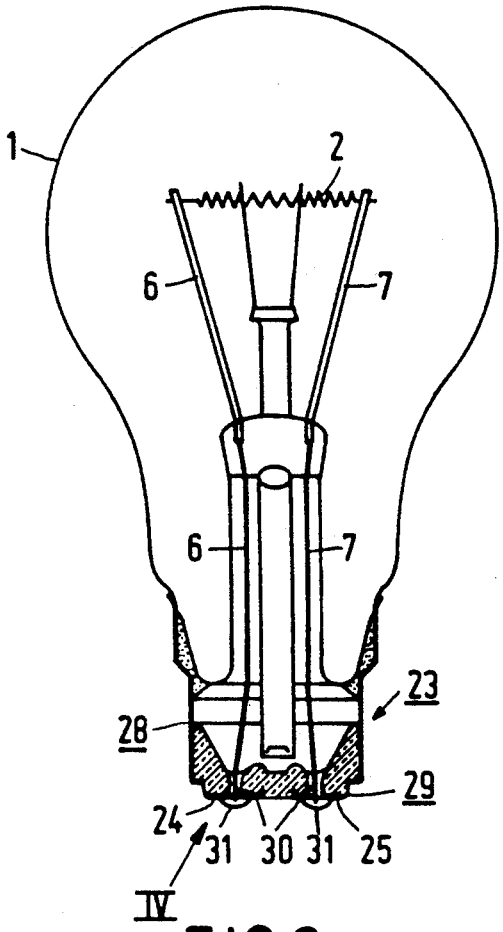
FIG. 2 shows a second embodiment in lateral elevation, with the lamp cap in longitudinal section.
Figure 3:
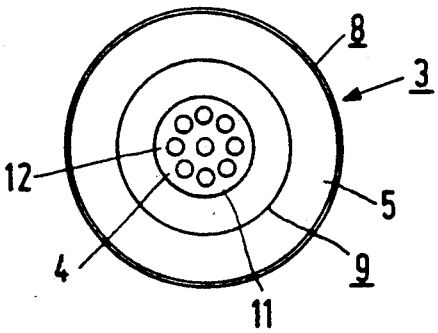
FIG. 3 shows a lamp cap of the lamp of FIG. 1 taken on the line III.
Figure 4:
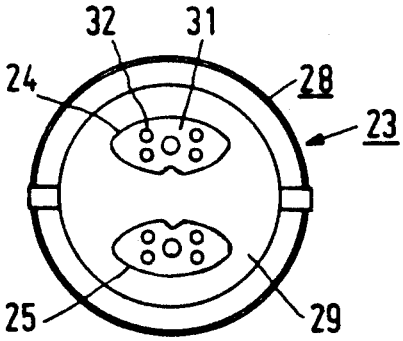
FIG. 4 shows the lamp cap of the lamp of FIG. 2 taken on the line IV.

In FIGS. 2 and 4, identical parts have the same reference numerals as those in FIGS. 1 and 3, while corresponding parts have reference numerals which are 20 higher than those in FIGS. 1 and 3. The lamp cap shown is of the bayonet type having two contacts at the base. An additional coupling between base 29 and contacts 24, 25 at the base effected by material of the base which has penetrated the holes of the girdle 32 is important particularly in this type of lamp cap for helping to absorb shear stresses.

An attractive characteristic of the lamp according to the invention is that its lamp cap can be manufactured in conventional moulds.

We claim:

1. An electric lamp comprising:

a. a lamp vessel containing a light source and including at least a first current supply conductor which is electrically connected to the light source and which has a portion disposed exteriorly of the lamp vessel;

b. a lamp cap attached to the lamp vessel and including a base of insulating material carrying at least a first electrical contact, said base and said first electrical contact having respective openings which collectively form a passage for the exterior portion of the first current supply conductor, said first current supply conductor passing through the passage and being affixed to the first electrical contact with solder;

c. first and second current supply conductors electrically connecting the light source to the lamp cap, said first current supply conductor passing through the passage and being affixed to the first electrical contact with solder;

2. An electric lamp as in claim 1 where the holes are substantially filled with the base insulating material.

* * * * *